US007789022B2

(12) United States Patent
Pujol et al.

(10) Patent No.: US 7,789,022 B2
(45) Date of Patent: Sep. 7, 2010

(54) VEHICLE DOOR PROVIDED WITH A JOINT

(75) Inventors: Claude Pujol, Rueil Malmaison (FR); Jérôme Jung, Haguenau (FR)

(73) Assignee: Alstom Transport SA, Levallois-Perret (FR)

( * ) Notice: Subject to any disclaimer, the term of this patent is extended or adjusted under 35 U.S.C. 154(b) by 104 days.

(21) Appl. No.: 11/661,367

(22) PCT Filed: Aug. 26, 2005

(86) PCT No.: PCT/FR2005/002159

§ 371 (c)(1),
(2), (4) Date: Jul. 17, 2008

(87) PCT Pub. No.: WO2006/027472

PCT Pub. Date: Mar. 16, 2006

(65) Prior Publication Data

US 2008/0282614 A1 Nov. 20, 2008

(30) Foreign Application Priority Data

Aug. 27, 2004 (FR) ..... 04 09165

(51) Int. Cl.
*B61D 19/00* (2006.01)

(52) U.S. Cl. ..... 105/343; 105/333; 105/339; 296/146.9; 296/155

(58) Field of Classification Search ..... 105/343, 105/332, 333, 339; 49/404, 413, 226; 296/155, 296/146.9, 146.13
See application file for complete search history.

(56) References Cited

U.S. PATENT DOCUMENTS

| | | | | |
|---|---|---|---|---|
| 3,456,389 | A * | 7/1969 | Dean | 49/253 |
| 4,087,939 | A * | 5/1978 | Elguindy et al. | 49/118 |
| 4,157,846 | A * | 6/1979 | Whitcroft | 296/155 |
| 4,544,198 | A * | 10/1985 | Ochiai et al. | 296/155 |
| 6,330,763 | B1 * | 12/2001 | Kern et al. | 49/231 |
| 7,364,219 | B2 * | 4/2008 | Lowson et al. | 296/155 |

FOREIGN PATENT DOCUMENTS

| | | |
|---|---|---|
| DE | 37 10 451 A1 | 10/1988 |
| FR | 2 572 701 | 5/1986 |

* cited by examiner

*Primary Examiner*—S. Joseph Morano
*Assistant Examiner*—Zachary Kuhfuss
(74) *Attorney, Agent, or Firm*—Davidson, Davidson & Kappel, LLC

(57) ABSTRACT

The invention relates to a railway vehicle including a body defining a wall in which an access passage is embodied, at least one closing sliding door, a sealing joint carried by the door and applicable to the wall when said door in a closed position. Said wall includes a panel provided with a generally cylindrical envelop and a seat which is protruded with respect to said panel and defines a bearing surface for supporting the joint only when the door is in the closed position, wherein said bearing surface of a supporting element extends along a profile substantially identical to the joint profile and said joint profile extends transversely with respect to the door displacement direction.

8 Claims, 3 Drawing Sheets

VEHICLE DOOR PROVIDED WITH A JOINT

The present invention relates to a railroad vehicle, of the type having a body delimiting a wall in which an access passage is formed; at least one sliding closing door, slidable in a direction of movement parallel to the wall between a position in which the passage is closed and a position in which the door is retracted along the wall away from the passage; and a sealing joint which is carried by a supporting element belonging to either the wall or the door and can be pressed, when the door is in the closed position, against a joint bearing element formed by the other of the wall and the door to provide a seal, this bearing element including a panel having a generally cylindrical shell.

BACKGROUND OF THE INVENTION

Passenger trains, particularly those for urban and suburban travel, are provided with sliding doors for closing the access passages leading to the inside of the trains. At present, a door of this type has a leaf which moves away from the passage, or two leaves which are placed side by side when in the closed position in front of the passage and which move away from each other towards their retracted position with one on each side of the passage.

To ensure sealing against wind, for example, as well as rain or pressure waves, the doors are provided with a sealing joint on their periphery. This sealing joint is pressed onto the outer surface of the flat wall of the vehicle at the edge of the passage when the door is in the closed position When the door moves in a rectilinear way parallel to the flat wall of the vehicle, the joint remains in contact with this wall and rubs against it. The joint therefore rapidly deteriorates and the surface of the wall is degraded by the friction of the joint.

Some doors are mounted to be movable along the wall of the vehicle with a complex non-rectilinear movement which enables the door, when it is opened, to be initially moved away from the wall in order to detach the joint and then to be simply moved along the wall.

The means required to provide this movement of the door are relatively complicated and costly.

There are also known inflatable joints which expand when the door is in the closed position to bear on the wall, and which retract to move away from the wall when the door is to be opened. These joints are costly and must be formed from a flexible material which has poor vandal-resistance.

SUMMARY OF THE INVENTION

An object of the invention is to propose a railroad vehicle having doors provided with sealing joints which have a limited production cost while having a considerable service life.

The invention provides a railroad vehicle of the aforementioned type, characterized in that the support element includes a seat projecting from the panel, this seat forming a bearing surface for the bearing of the joint only when the door is in the closed position, this bearing surface of the support element extending along a profile substantially identical to that of the joint, and the profile of the joint extending transversely to the direction of movement of the door.

In specific embodiments, the railroad vehicle has one or more of the following characteristics, which are present separately or jointly in all technically feasible combinations:

the support element is the wall and the joint is carried by the door;

the seat delimits a frame forming a door frame which is applied and fixed to the wall panel;

the seat is formed by a bulge in the wall of the body;

the joint has a generally polygonal outer profile, and none of the edges of the polygon formed by the joint extends parallel to the direction of movement;

the bearing surface has a perpendicular facing towards the outside of the passage;

the seat is edged, on the side corresponding to the central part of the door, with a gutter for draining runoff water which is transverse with respect to the direction of movement;

the door can only be moved with a translational movement with respect to the wall, this movement being generally parallel to the plane of the panel;

when the door is outside its closed position, the joint is separated from the main panel of the support element;

the body has a step on a lower edge of the passage, and the door is designed so that it covers the step when in the closed position.

BRIEF DESCRIPTION OF THE DRAWINGS

The invention will be more clearly understood with the aid of the following description which is provided solely by way of example and which refers to the drawings, in which.

DETAILED DESCRIPTION

Figure 1:
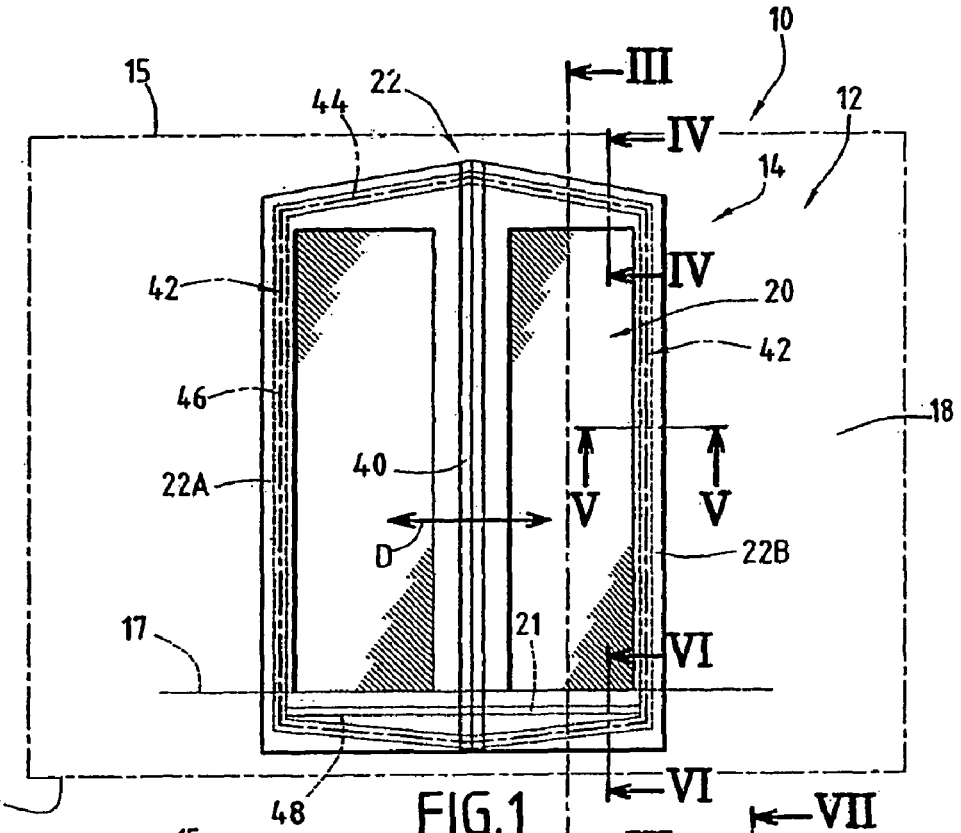
FIG. 1 is a partial side elevation of a railroad vehicle according to the invention with the door closed.

FIG. 1 shows part of a car 10 of a passenger train. This car forms a railroad vehicle having a body 12 delimiting accommodation for passengers.

As is known, the body is generally tubular and has two opposing side walls 14, a roof 15 and a base 16.

A floor 17 is provided in the body for the use of the passengers.

In the example in question, the wall 14 comprises a panel 18 having a generally cylindrical shell; in other words, the panel is formed by the movement of a generatrix along a closed contour corresponding to the cross section of the body.

Passages 20 for access to the inside of the body are formed in the side walls 14 at regular intervals. These passages open over most of the height of the body. In the lower part of each passage, a step or set of steps 21 is formed, allowing a passenger to reach the floor 17 of the car from a platform extending at a lower level.

A door 22 is provided to close each passage 20 and to cover the step 21. In the example in question, the door 22 has two leaves 22A, 22B which are symmetrical to each other about a vertical axis. They can be moved between a closed position in which the two leaves are placed side by side along a vertical edge and in which they extend in front of the passage 20, and a retracted position in which each leaf 22A, 22B extends along the wall 14 away from the passage 20 and from the step 21, thus permitting access by passengers.

Figure 2:
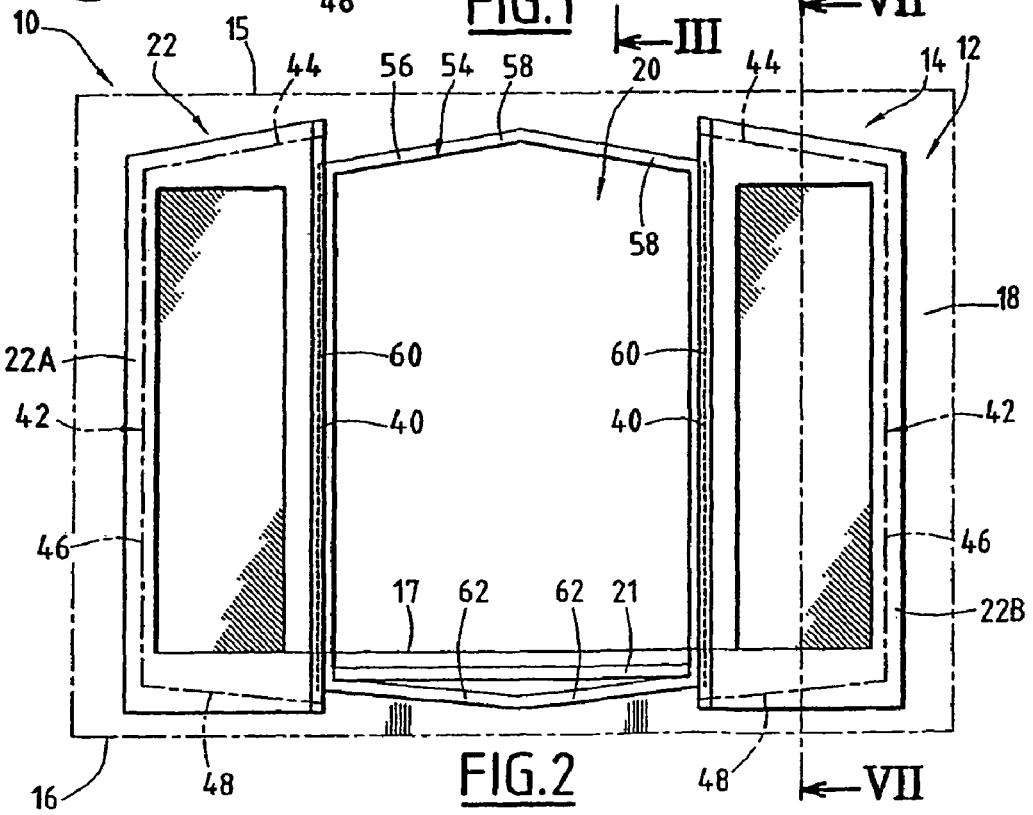
FIG. 2 is a view identical to that of FIG. 1 with the door open.
Figure 3:
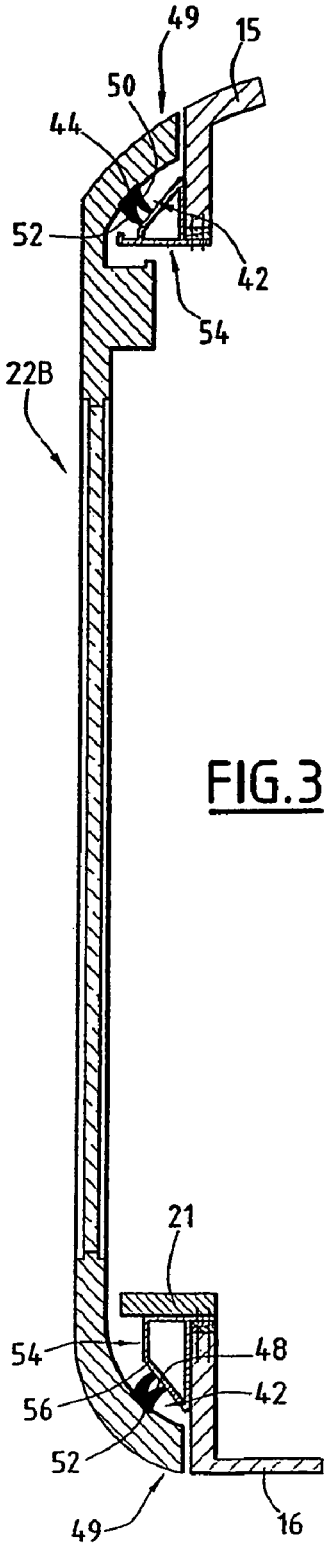
FIG. 3 is a section through the vehicle of FIG. 1, taken along the line III-III when the door is closed.

Each leaf can be moved translationally in a rectilinear way parallel to the panel 18 in a direction of movement D shown in FIGS. 1 and 2. This direction of movement is, for example, perpendicular to the vertical axis of symmetry of the leaves 22A, 22B.

For this purpose, the leaves 22A, 22B are carried by upper and lower rails (not shown) which are fixed to the body. The leaves have rolling members housed in these rails.

In addition, an operating mechanism, such as a set of actuators, is positioned between the body and the leaves to enable the leaves to be moved along the rails.

Each leaf 22A, 22B has sealing joints on its periphery.

In particular, the leaves have complementary joints 40 on their facing edges, extending in the plane of the leaves and capable of pressing against each other when the door is in its closed position.

Additionally, each leaf 22A, 22B is provided on its outer longitudinal edge and along its upper and lower edges with an elongate sealing joint 42 carried by the surface of the leaf facing the body. This joint extends along a polygonal profile formed in the example in question by three successive segments 44, 46, 48 delimiting between them angles of more than 90°.

As shown in FIGS. 3, 4, 5 and 6, the joint 42 is carried by a re-entrant flange 49 formed around the edge of each leaf.

This flange is turned towards the panel 18 but is kept away from it.

Figure 7:
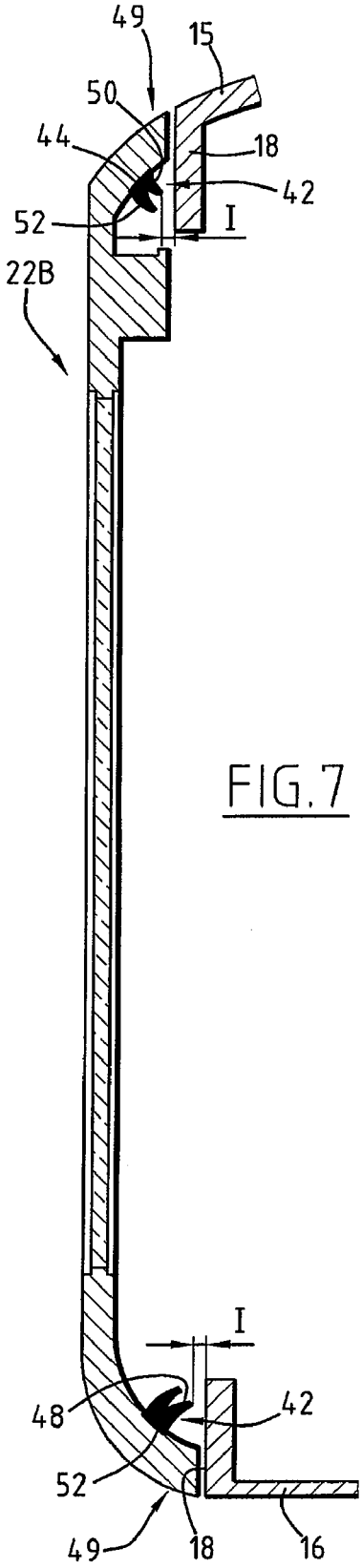
FIG. 7 is a sectional view of the vehicle of FIG. 2, taken along the line VII-VII when the door is open.

The joint 42 is fixed so that it is spaced apart from the panel 18 in all circumstances by a non-zero interval I shown in FIG. 7.

The profile of the joint 42 is defined in such a way that the joints always extend transversely to the direction of movement D of the door.

In particular, since the door 22 and the passage 20 are polygonal, the sides of the polygon carrying a joint are positioned in such a way that they do not extend parallel to the direction of movement D. The door and the passage can be of any shape, provided that the contact surface between the joint 42 and the bearing surfaces 58, 60, 62 of the joint are transverse to the direction D.

For the purposes of the present application, the term "transverse" or "transversely" is interpreted as meaning "not parallel to the direction D".

Thus, the longitudinal segment 46 of the joint extends over the height of each leaf 22A, 22B perpendicularly to the direction of movement D.

The upper segment 44 lies at an angle of about twenty degrees to the direction D, so that the height of the leaves in the vicinity of the joint 40 is greater than that of the leaf in the vicinity of the segment 46 of the joint.

Similarly, the lower segment 48 of the joint lies at an angle of about ten degrees to the direction D. It is substantially symmetrical with the segment of joint 46 about the direction D.

Thus, in the embodiment shown in the figures, each leaf has a generally trapezoid shape with its major base facing the other leaf and its minor base extending toward the outside of the opening. In other embodiments, which are not shown, the leaf (or leaves) can be of any shape, namely semi-elliptical (elliptical), rectangular, etc.

The elongate joint has a constant cross section. It is formed by two essentially parallel lips 50, 52. These lips are elastically deformable, thus enabling them to be compressed against a bearing surface. On the periphery of the passage 20, the bearing surface of the joint. 42 is formed by a seat 54 projecting outward from the panel 18 of the body 14.

The seat 54 forms a frame which borders the passage 20 in the region where the joints 42 are located when the leaves of the door shut off the passage 20.

The seat 54 forms a bearing surface 56 projecting from the panel 18 and extending along a profile corresponding to the profile of the joint 42, in other words along the whole length of the joint, the bearing surface extending opposite the position of the joint when the door is in the closed position.

Thus the bearing surface 56 has three successive segments 58, 60, 62, lying at angles of more than 90° to each other, as shown in FIG. 2. The bearing surfaces 56 are inclined and have a perpendicular facing the outside of the passage 20.

Figure 4:
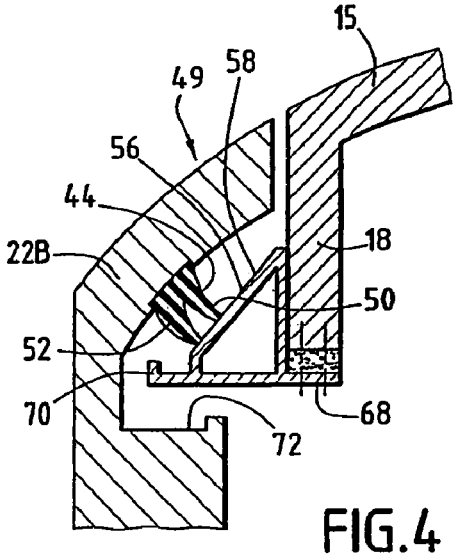
FIGS. 4, 5 and 6 are sectional views on a larger scale of a detail of the interface between the door and the wall of the vehicle, taken along the lines IV-IV, V-V and VI-VI in FIG. 1.
Figure 5:
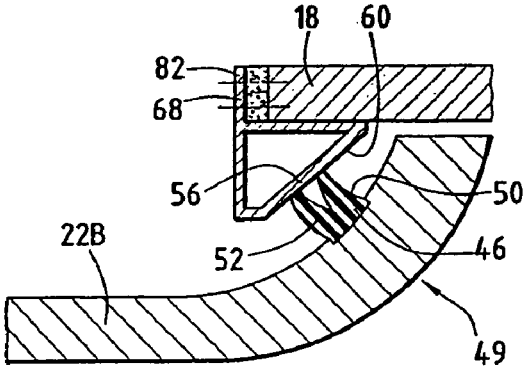
Figure 6:
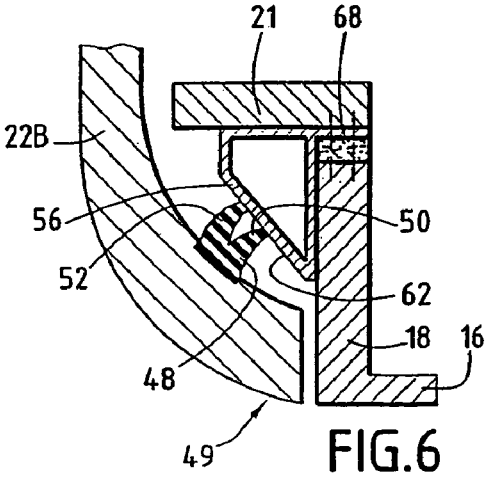
Figure 9:
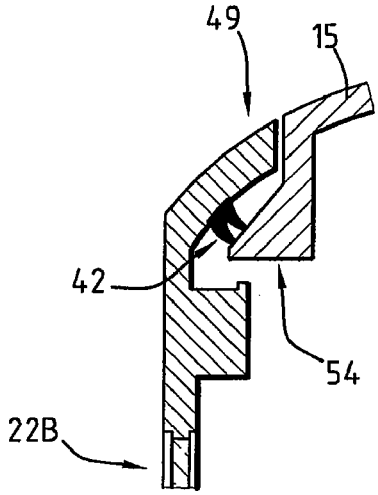

In the embodiment in question, the seat 54 is formed by a metal section shown in detail in FIGS. 4, 5 and 6, which forms a door frame delimiting the passage 20. This frame is applied to the panel 18 and is fixed, for example by means of bolts 66 inserted into a fixing flange 68 of the section. This fixing flange is applied and fixed to the face of the panel 18. The fixing flange is made in one piece with the bearing surface 56. In another embodiment, shown in FIG. 9, the seat is formed by a bulge in the wall 14 of the body.

In the upper segment 58, the edge of the bearing surface 54 is bordered with a gutter 70 for draining runoff water. Similarly, each leaf 20A, 20B is provided in its upper part with a generally horizontal gutter 72 positioned on its inner face and extending below the gutter 70. The gutter 70 is parallel to the joint 42 and to the bearing surface 56 in the upper part of the leaf, in such a way that the runoff water is drained more easily toward the outside of the doors by the gradients created by the polygonal shape of the upper part.

The segment 60 of the bearing surface shown in FIG. 5 extends in a generally vertical way.

The inner bearing surface 62 extends below a tread of the step 21 which is fixed to the fixing flange 68.

Clearly, when the door is in the closed position, the joints 42 are pressed against the bearing surfaces 56 of the seats 54, thus providing satisfactory sealing around the doors.

When the door is opened by the movement of the leaves in the direction D, the joints 42 are immediately detached from the seats 54, since the joints extend transversely to the direction of movement D of the doors. Thus, when the joints have been detached, they are moved by being carried by the door along the panels 18 without coming into contact with the latter.

When the doors are closed, the leaves are brought back into place and the joints 42 do not come into contact with the seats 54 until the final stage of the approach to the closed position.

Clearly, the joints are not in contact with the walls 14 when the leaves are moved, and therefore they do not become worn and do not degrade the wall surface. The presence of the projecting seat 54 for the bearing of each joint makes it possible to have a door whose movement is very simple, since it is exclusively translational, with no need for complex movements to bring the joint into contact with the support element.

Figure 8:
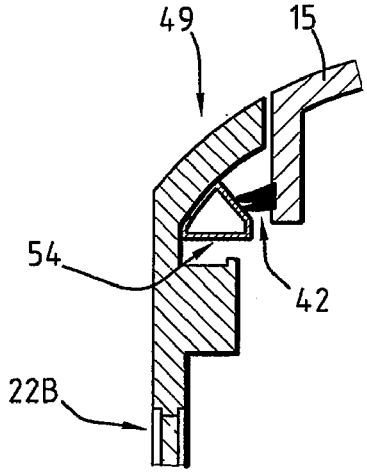
FIGS. 8 and 9 are similar views as FIG. 4 of a detail of a railroad according to second and third embodiments.

In a variant, shown in FIG. 8, the joint is carried not by the sliding door but by the wall 14 of the body, and the seat is formed on the sliding door, in which case the sliding door is closed by a generally cylindrical solid panel having a projecting seat on which the joint bears.

Clearly, the joint profile can be of any shape, as long as it is not parallel to the direction of movement. For example, the door and joint can advantageously be circular or elliptical.

Finally, in a variant, the door has only one leaf.

What is claimed is:

1. A railroad vehicle comprising:

a body delimiting a wall having an access passage;

at least one sliding closing door, slidable in a direction of movement parallel to the wall between a closed passage position and a retracted position, the door being retracted along the wall away from the passage in the retracted position;

a sealing joint carried by a support element belonging to the door and pressable, when the door is in the closed position, onto a joint bearing element formed by the wall to provide a seal, the support element including a panel; and the support element including a seat projecting from the panel, the seat forming a bearing surface on which the sealing joint bears only when the door is in the closed position, the bearing surface of the support element extending along a profile similar to a joint profile, and the joint profile extending transversely to the direction of movement of the door;

wherein the door can be moved only by a translational movement with respect to the wall, the movement being parallel to a plane of the panel.

2. The vehicle as recited in claim 1 wherein the seat delimits a frame forming a door frame applied and fixed to the panel of the wall.

3. A railroad vehicle comprising:

a body delimiting a wall having an access passage;

at least one sliding closing door, slidable in a direction of movement parallel to the wall between a closed passage position and a retracted position, the door being retracted along the wall away from the passage in the retracted position;

a sealing joint carried by a support element belonging to the door and pressable, when the door is in the closed position, onto a joint bearing element formed by the wall to provide a seal, the support element including a panel; and the support element including a seat projecting from the panel, the seat forming a bearing surface on which the sealing joint bears only when the door is in the closed position, the bearing surface of the support element extending along a profile similar to a joint profile, and the joint profile extending transversely to the direction of movement of the door;

wherein the sealing joint has a polygonal outer profile, and none of the sides of the polygon formed by the sealing joint extends parallel to the direction of movement.

4. The vehicle as recited in claim 1 wherein the bearing surface has a perpendicular surface facing the outside of the passage.

5. The vehicle as recited in claim 1 wherein the seat is bordered, on the side corresponding to the central part of the door, with a gutter for draining runoff water, transverse to the direction of movement D.

6. The vehicle as recited in claim 1 wherein when the door is outside its closed position, the sealing joint is separated from the main panel of the support element.

7. The vehicle as recited in claim 1 wherein the body has a step along a lower edge of the passage, and the door is designed to cover the step in the closed position.

8. A railroad vehicle comprising:

a body delimiting a wall having an access passage;

at least one sliding closing door, slidable in a direction of movement parallel to the wall between a closed passage position and a retracted position, the door being retracted along the wall away from the passage in the retracted position;

a sealing joint carried by a support element belonging to the wall and pressable, when the door is in the closed position, onto a joint bearing element formed by the door to provide a seal, the support element including a panel; and the support element including a seat projecting from the panel, the seat forming a bearing surface on which the sealing joint bears only when the door is in the closed position, the bearing surface of the support element extending along a profile similar to a joint profile, and the joint profile extending transversely to the direction of movement of the door;

wherein the door can be moved only by a translational movement with respect to the wall, the movement being parallel to a plane of the panel.

* * * * *